US007980960B2

(12) United States Patent
Gilbert et al.

(10) Patent No.: US 7,980,960 B2
(45) **Date of Patent: *Jul. 19, 2011**

(54) IRON-TYPE GOLF CLUBS

(75) Inventors: Peter J. Gilbert, Carlsbad, CA (US); David A. Shear, Raleigh, NC (US)

(73) Assignee: Acushnet Company, Fairhaven, MA (US)

( * ) Notice: Subject to any disclaimer, the term of this patent is extended or adjusted under 35 U.S.C. 154(b) by 750 days.

This patent is subject to a terminal disclaimer.

(21) Appl. No.: 11/423,290

(22) Filed: Jun. 9, 2006

(65) Prior Publication Data

US 2007/0287554 A1 Dec. 13, 2007

(51) Int. Cl.
*A63B 53/04* (2006.01)

(52) U.S. Cl. ..... 473/290; 473/291; 473/342; 473/349; 473/350

(58) Field of Classification Search ..... 473/324–350, 473/287–292
See application file for complete search history.

(56) References Cited

U.S. PATENT DOCUMENTS

| | | | | | |
|---|---|---|---|---|---|
| 4,063,733 | A | | 12/1977 | Benedict | |
| 4,247,105 | A | * | 1/1981 | Jeghers | 473/291 |
| 4,558,863 | A | | 12/1985 | Haas et al. | |
| 4,667,963 | A | * | 5/1987 | Yoneyama | 473/348 |
| 4,708,347 | A | * | 11/1987 | Kobayashi | 473/338 |
| 4,874,171 | A | * | 10/1989 | Ezaki et al. | 473/290 |
| 4,928,972 | A | | 5/1990 | Nakanishi | |
| 5,062,638 | A | * | 11/1991 | Shira | 473/350 |
| 5,326,106 | A | | 7/1994 | Meyer | |
| 5,348,302 | A | * | 9/1994 | Sasamoto et al. | 473/346 |
| 5,439,223 | A | * | 8/1995 | Kobayashi | 473/334 |
| 5,564,705 | A | * | 10/1996 | Kobayashi et al. | 473/334 |
| 5,749,794 | A | * | 5/1998 | Kobayashi et al. | 473/342 |
| 5,833,551 | A | * | 11/1998 | Vincent et al. | 473/350 |
| 5,967,903 | A | | 10/1999 | Cheng | |
| 6,012,990 | A | * | 1/2000 | Nishizawa | 473/345 |
| 6,045,456 | A | | 4/2000 | Best et al. | |
| 6,769,998 | B2 | * | 8/2004 | Clausen et al. | 473/342 |
| 6,860,823 | B2 | * | 3/2005 | Lee | 473/329 |
| 6,875,124 | B2 | * | 4/2005 | Gilbert et al. | 473/290 |
| 6,896,627 | B2 | * | 5/2005 | Hou | 473/335 |
| 6,929,563 | B2 | * | 8/2005 | Nishitani | 473/334 |
| 7,048,648 | B2 | * | 5/2006 | Breier et al. | 473/340 |
| 7,207,899 | B2 | * | 4/2007 | Imamoto | 473/332 |
| 7,232,380 | B2 | * | 6/2007 | Nakahara | 473/324 |
| 7,811,179 | B2 | * | 10/2010 | Roach et al. | 473/335 |
| 2003/0181259 | A1 | * | 9/2003 | Shimazaki | 473/350 |
| 2005/0181887 | A1 | | 8/2005 | Sano et al. | |
| 2006/0073907 | A1 | * | 4/2006 | Murphy | 473/329 |

* cited by examiner

*Primary Examiner* — Sebastiano Passaniti
(74) *Attorney, Agent, or Firm* — Randy K. Chang

(57) ABSTRACT

An iron-type golf club includes a conventional-weight section, a lightweight section and a heavyweight section. The conventional-weight section includes the hitting face and at least a portion of the hosel. The heavyweight section, made of a denser material than the conventional-weight section, includes the sole and an optional back flange. The lightweight section, made of a material less dense than either of the other sections, includes a core to which the other two sections are secured, such as by co-molding the core to the other two sections. The heavyweight section includes anchoring structures to which the lightweight section can securely attach. This arrangement maintains the overall weight of the club head compared to a similarly proportioned conventional club head while shifting the center of gravity low and aft. As such, the club head provides benefits such as forgiveness for thin shots, heel/toe shots, and provides longer drives with less roll.

18 Claims, 13 Drawing Sheets

CG Position Nomenclature for Irons

3-IRONS

G-IRONS

6-IRONS

9-IRONS

9-IRONS

IRON-TYPE GOLF CLUBS

FIELD OF THE INVENTION

This invention generally relates to golf clubs, and, more particularly, to iron clubs.

BACKGROUND OF THE INVENTION

Individual iron club heads in a set typically increase progressively in face surface area and weight as the clubs progress from the long irons to the short irons and wedges. Therefore, the club heads of the long irons have a smaller face surface area than the short irons and are typically more difficult for the average golfer to hit consistently well. For conventional club heads, this arises at least in part due to the smaller sweet spot of the corresponding smaller face surface area.

To help the average golfer consistently hit the sweet spot of a club head, many golf clubs are available with cavity back constructions for increased perimeter weighting. Perimeter weighting also provides the club head with higher rotational moment of inertia about its center of gravity. Club heads with higher moments of inertia have a lower tendency to rotate caused by off-center hits. Another recent trend has been to increase the overall size of the club heads. Each of these features increases the size of the sweet spot, and therefore makes it more likely that a shot hit slightly off-center still makes contact with the sweet spot and flies farther and straighter. One challenge for the golf club designer when maximizing the size of the club head is to maintain a desirable and effective overall weight of the golf club. For example, if the club head of a three iron is increased in size and weight, the club may become more difficult for the average golfer to swing properly.

In general, to increase the sweet spot, the center of gravity of these clubs is moved toward the bottom and back of the club head. This permits an average golfer to launch the ball up in the air faster and hit the ball farther. In addition, the moment of inertia of the club head is increased to minimize the distance and accuracy penalties associated with off-center hits. In order to move the weight down and back without increasing the overall weight of the club head, material or mass is taken from one area of the club head and moved to another. One solution has been to take material from the face of the club, creating a thin club face. Examples of this type of arrangement can be found in U.S. Pat. Nos. 4,928,972, 5,967,903 and 6,045,456.

However, thinning the hitting face of the club is limited in the impact on the total mass distribution of a club head, as a minimum thickness for hitting face materials should be maintained to avoid failure due to repeated impact forces. Therefore, there exists a need in the art additional ways in which to manipulate the mass distribution of a club head.

SUMMARY OF THE INVENTION

According to one aspect of the present invention, an iron-type club head includes a first section comprising a hitting face, wherein the first section comprises a first material having a first density. A second section is connected to the first section, wherein the second section comprises a second material having a second density, wherein the second density is less than the first density. A third section comprises a sole and is connected to the first section and the second section, wherein the third section comprises a third material having a third density, wherein the third density is greater than the first density.

According to another aspect of the present invention, an iron-type golf club comprises three portions, wherein the density of each portion is different from each other by more than about 3 grams/cm$^3$.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
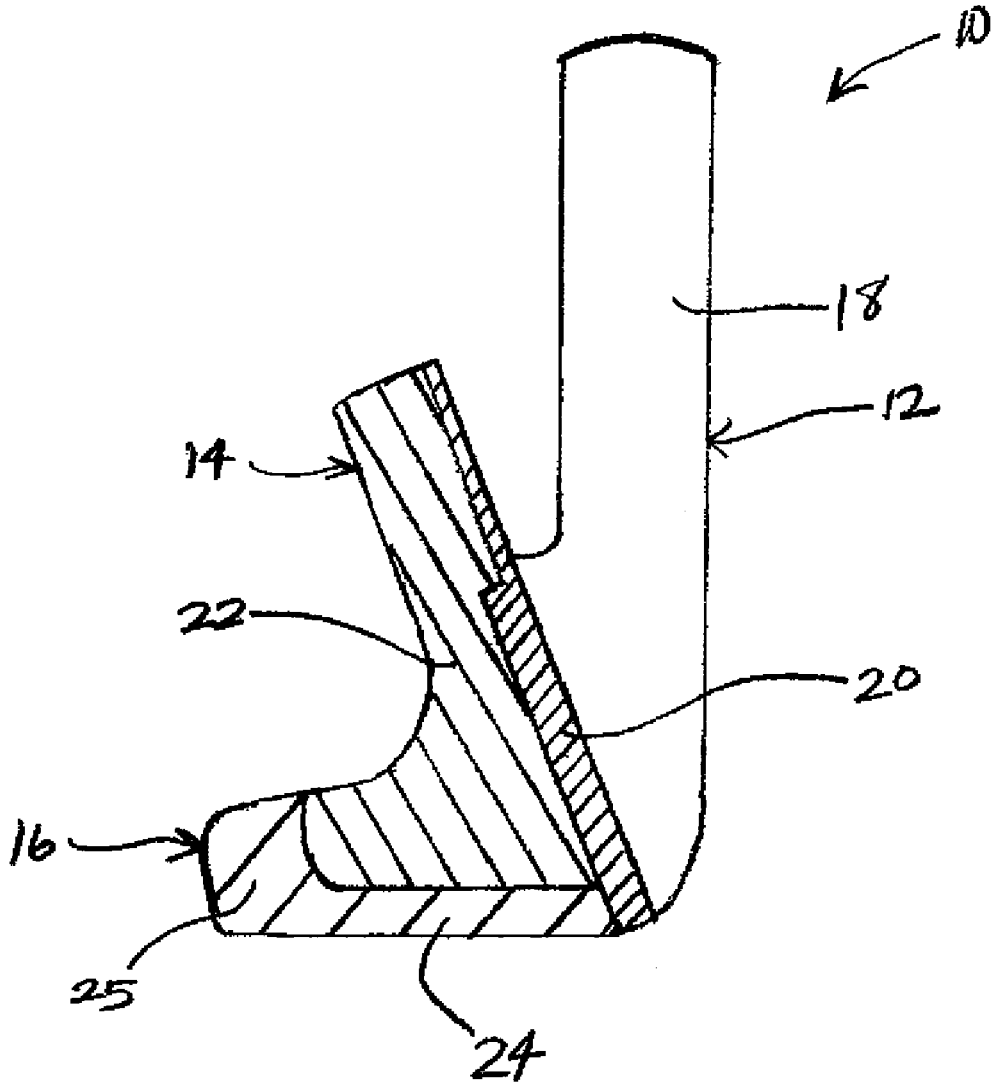
FIG. 1 is a cross-sectional schematic view of a golf club head according to the present invention.

As illustrated in the accompanying drawings and discussed in detail below, the present invention is directed to an iron-type golf club head. FIG. 1 shows an iron-type club head 10 according to the present invention that distributes the mass of club head 10 so that the center of gravity is shifted toward the sole and aft while maintaining the overall mass of a conventional club head.

Club head 10 includes, generally, three portions: a conventional-weight section 12, a lightweight section 14, and a heavyweight section 16. These sections 12, 14, 16 are joined together to obtain the desired mass distribution for club head 10. Preferably, club head 10 is an iron-type club head with a muscle-back configuration, although any type of club with any configuration known in the art, such as a cavity-back iron or a hybrid is also contemplated by the present invention Conventional-weight section 12 preferably includes at least a section of a hosel 18 and a hitting face 20. Preferably, hitting face 20 is formed as a relatively thin plate. Preferably, hitting face 20 and hosel 18 are made of the same conventional material, such as various types of steel, for example, ss410, ss431, ss304 and carbon steel. A preferred density for the material for conventional-weight section 12 is about 8 g/cc, although the density preferably ranges from about 5 g/cc to about 9 g/cc. Hitting face 20 and hosel 18 may be manufactured using any method known in the art, such as by casting, forging, metal injection molding, pressing and sintering, hot isostatic pressing (HIP), etc. Hitting face 20 and hosel 18 are preferably formed as a unitary piece, however, in other embodiments, portions or the entirety of hitting face 20 and hosel 18 may be manufactured separately and then joined together using any method known in the art, such as welding, riveting, affixing with an adhesive such as epoxy, or the like. Conventional-weight section 12 provides a golfer with desirable aesthetic attributes, for example, feel during play, and ease of custom grinding features.

Heavyweight section 16 preferably includes a sole portion 24 and a back flange 25. Heavyweight section 16 is made of a material that is significantly more dense than the conventional material used in conventional-weight section 12. Preferably, the density of the material for heavyweight section 16 ranges from about 10 g/cc to about 20 g/cc, more preferably from 16 g/cc to about 20 g/cc and more preferably from about 18 g/cc to 19 g/cc. For example, tungsten, tungsten alloys, such as tungsten nickel, or tungsten-loaded plastic may be used to form heavyweight section 16. Heavyweight section 16 may be manufactured using any method known in the art, such as by forging, casting, metal injection molding, pressing and sintering or HIP if metal or metal alloys are used or by molding if a plastic or other moldable material is used. Heavyweight section 16 may be attached to conventional-weight section 12 by any method known in the art, such as by welding or by the inventive method described in detail below.

Lightweight section 14 connects conventional-weight section 12 and heavyweight section 16, providing structural support for hitting face 20 and material to fill the preferred volume of club head 10 while not adding significant mass to club head 10. Lightweight section 14 is preferably positioned behind hitting face 20 to form a core 22 and back portion of club head 10. In another embodiment, a portion of hosel 18 is also formed from a lightweight material. Lightweight section 14 is preferably made of a lightweight material having a density from about 0.5 g/cc to about 5.8 g/cc. More preferably, the density of lightweight section 14 is less than about 3 g/cc. Preferred materials for lightweight section 14 include plastic, urethane, wood, aluminum silica, magnesium, and aluminum.

Sections 12, 14, 16, which comprise club head 10, may be attached to each other by any method known in the art, such as welding, fusion bonding with screws, rivets, snap fit, interference fit, adhesives such as epoxy and adhesive tape, and the like. However, when relatively incompatible materials are used for sections 12, 14, and 16, such as when a moldable material is used to form lightweight section 14, due to the material differences of the three sections 12, 14, 16 that join to form club head 10, connecting the sections 12, 14, 16 so as to be able to withstand repeated impacts with golf balls without separating may be challenging.

As such, club head 10 is preferably made by first forming conventional-weight section 12 and heavyweight section 16, using any of the methods known in the art as described above. Conventional-weight section 12 and heavyweight section 16 may then be milled or machined into any desired shape or with any desired characteristic, such as to roughen the surfaces to which lightweight section 14 is to be affixed, or to provide anchoring structures on those surfaces, as discussed in greater detail below.

Conventional-weight section 12 and heavyweight section 16 are then inserted into a mold, wherein the mold cavity is configured to have the final desired shape of club head 10. As such, conventional-weight section 12 and heavyweight section 16 can be fitted into those portions of the mold cavity that conform to the shapes of portions 12, 16. Moldable material forming the lightweight section 14 is then formed by introducing the molten moldable or curable material into the mold cavity. When cooled and removed from the mold, sections 12, 14 and 16 are co-molded together to form a single, unitary club head 10. Additional joining structures, such as screws, rivets, or the like may then be inserted to secure sections 12, 14 and 16 together. The moldable material can be a thermoplastic or thermoset plastic.

Figure 2:
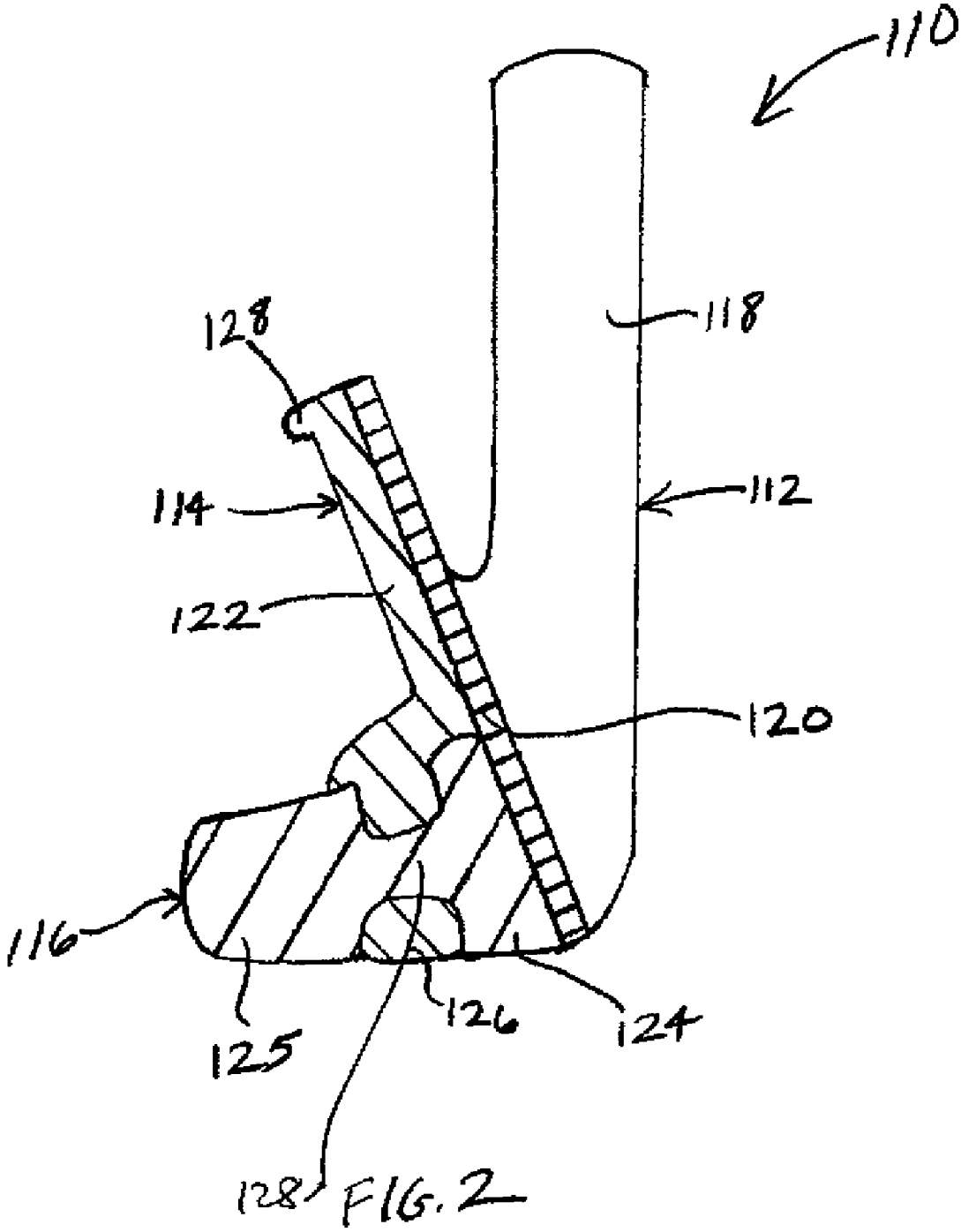
FIG. 2 is a cross-sectional schematic view of another embodiment of a golf club head according to the present invention.
Figure 3:
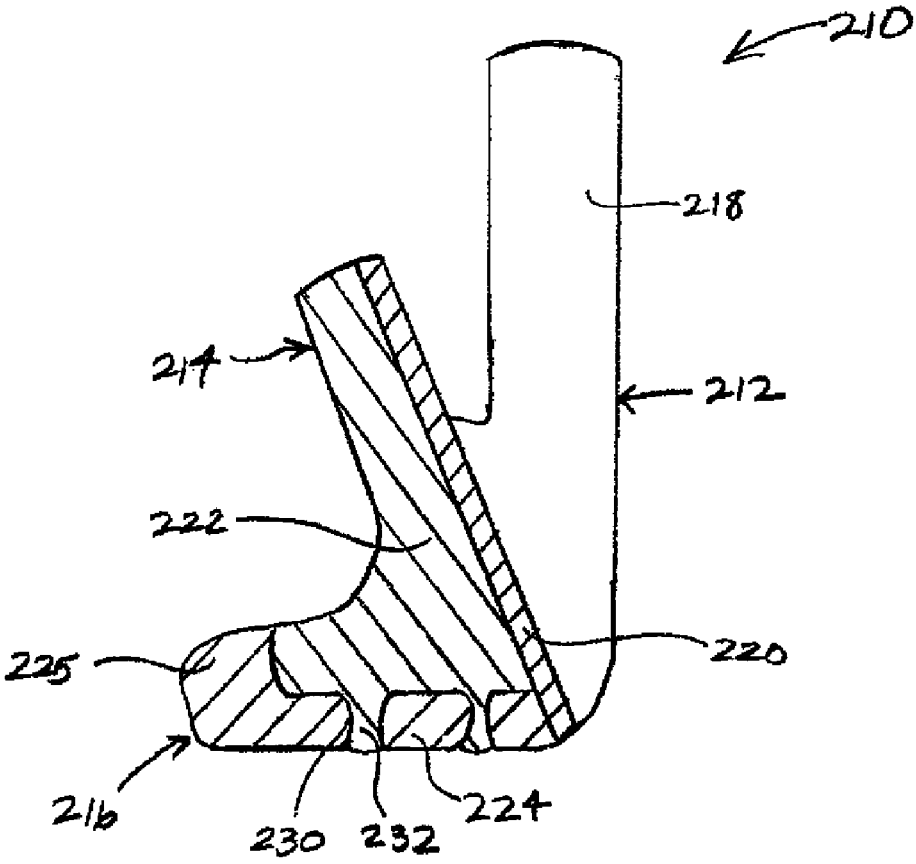
FIG. 3 is a cross-sectional schematic view of another embodiment of a club head according to the present invention.
Figure 4:
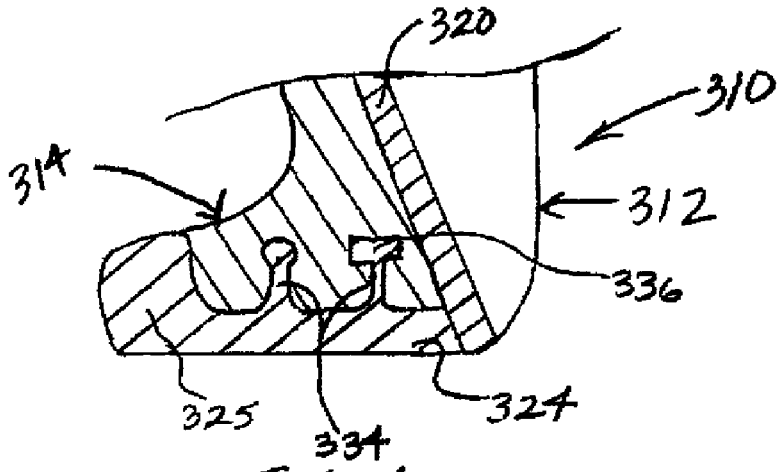
FIG. 4 is a partial cross-sectional schematic view of another embodiment of a club head according to the present invention.

Lightweight section 14 can therefore also take on any of a multitude of configurations, such as the shape shown in FIG. 1, but also, for example, those shown in FIGS. 2-4. In FIG. 2, a club head 110 is shown, where club head 110 is similar to club head 10 described above: three sections, a conventional-weight section 112, a lightweight section 114, and a heavyweight section 116 are joined together to form club head 110. These sections 112, 114 and 116 correspond to sections 12, 14 and 16, respectively, in material choice (e.g. density, strength, etc.) and general configuration. However, the actual shapes of sections 112, 114 and 116 differ from those of sections 12, 14 and 16. For example, hitting face 120 of section 112 has uniform thickness, while hitting face 20 has a step to reduce the thickness thereof near the upper perimeter, as discussed above. Additionally, core 122 is configured with a rim 128 along the upper perimeter, in order to shift additional weight to the perimeter.

Further, in this embodiment in order to support the adhesion of lightweight section 114 and heavyweight section 116, heavyweight section 116 is preferably configured with at least one structure that can anchor lightweight section 114 to heavyweight section 116. A hole or slot may be formed in heavyweight section 116, such as by milling or machining. A portion 126 of lightweight section 114 may then extend into the slot, such as by press-fitting an extension of lightweight section 114 into the slot or molding a portion of lightweight section 114 into the slot. This additional portion enhances the joining together of lightweight section 114 and heavyweight section 116.

Alternatively, heavyweight section 116 has front portion 124 connected to back portion 125 by one or more post 128 and lightweight section 114 is formed by molding a polymeric material around post(s) 128 as shown. Prior to co-molding, heavyweight section 116 can be welded, fusion bonded, or affixed by screws to conventional-weight section 112.

FIGS. 3 and 4 show additional embodiments of club heads according to the present invention. Club head 210 as shown in FIG. 3 is substantially similar to club head 10 as shown in FIG. 1. However, club head 210 includes a heavyweight section 216 with two channels 230 formed through a sole 224. Preferably, as molten moldable material is introduced or co-molded to form a lightweight section 214, the material forms not only a core 222 but also extends into channels 230 to form anchoring pins 232. Pins 232 provide additional support for the joining together of lightweight section 214 and heavyweight section 216. As will be recognized by those in the art, lightweight section 214 may be milled, molded or machined to form core 222 and anchoring pins 232, with pins 232 then inserted into channels 230 and affixed therein.

Similarly, FIG. 4 shows a portion of a club head 310 which is also substantially similar to club heads 10 and 210 as discussed above. In this embodiment, a heavyweight portion 316 includes anchoring posts 334 extending into a lightweight portion 314. As molten moldable material is introduced or co-molded to form lightweight portion 314, the material flows around and surrounds anchoring posts 334. As the moldable material cools, anchoring posts 334 become embedded within lightweight portion 314, thereby providing a more secure joint for lightweight section 314 and heavyweight section 316. Preferably, anchoring posts 334 include caps 336 which have larger diameters than the rest of posts 334, such as disks or balls positioned within lightweight section 314. As such, even if posts 334 begin to separate from lightweight section 314 due to impact forces, heavyweight portion 316 is still securely held in position as caps or enlarged heads 336 cannot be extracted from lightweight core through the void created by posts 334. As will be recognized by those in the art, lightweight section 314 may be milled, molded or machined to form channels for anchoring posts 334 which may then be inserted into channels 230, such as by press-fitting caps 336 into position, and affixed therein.

Referring again to FIG. 1 for the sake of clarity, even though the following discussion applies equally to all club heads made in accordance with the present invention, once assembled, club head 10 includes a conventional-weight mid-weight section 12 forming hitting face 20 and hosel 18, a relatively heavy section 16 forming a lower portion of club head 10, and a relatively light section forming much of the central portion of club head 10. As such, the total mass of club head 10 is shifted compared with a club head having a traditional structure made of a uniform material or several materials of relatively similar density. In inventive club head 10, heavier material in the upper structure thereof is replaced by lightweight core 22, thereby shifting the mass distribution toward hitting face 20 and sole 24. This re-distribution is enhanced by replacing lighter conventional material with a heavier material for sole 24 and back flange 25, thereby shifting the mass toward sole 24 and back flange 25. As such, with a combination of conventional, lightweight and heavy materials used for club head 10, the total mass of club head 10 can be substantially the same as a similarly-sized conventional club head, but the mass distribution in inventive club head 10 is different from such a conventional club head.

| | Density Range | Exemplary Materials |
|---|---|---|
| Conventional Weight | 5.0 g/cc-9.0 g/cc | carbon steel, stainless steel 410, 431, or 304, |

-continued

| | Density Range | Exemplary Materials |
|---|---|---|
| Section | | titanium |
| Lightweight Section | 0.5 g/cc-5.8 g/cc | polymers, aluminum, wood, Kevlar |
| Heavyweight Section | 10 g/cc-19 g/cc | tungsten, tungsten alloys, lead |

In accordance with one aspect of the present invention, the difference in density between the three (or more) sections of clubhead 10 is at least about 3 g/cc, preferably at least about 4 g/cc and more preferably at least about 5 g/cc.

In inventive club head 10, the center of gravity of club head 10 is shifted toward the sole and aft of the center of gravity of a conventional club head. Such a center of gravity is a more ideal location for trajectory optimization, as an average golfer may launch the ball up in the air faster and hit the ball farther, as discussed above. Additionally, a low and aft center of gravity will be more forgiving of "thin" hits, when the ball and club connect below the optimal striking point of about 18 mm above the ground when the club is in the address position, and "fat" hits, when the ball and club connect above the optimal striking point. Similarly, a low and aft center of gravity will be more forgiving of shots hit heel-ward or toe-ward of the optimal striking point.

Figure 5:
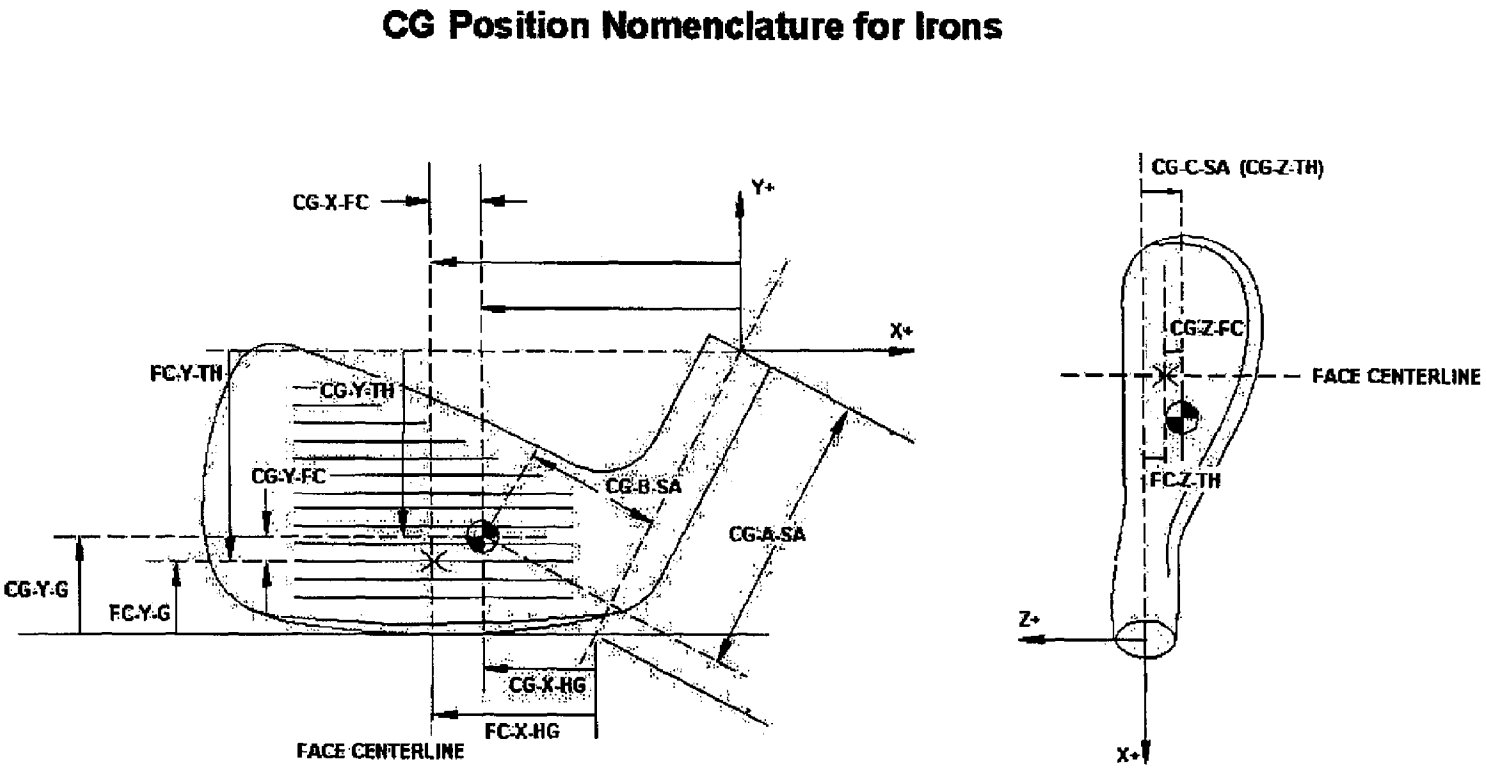
FIG. 5 is a schematic view of a generic iron-type golf club head showing center of gravity positions.

The following example shows how shots hit with inventive club head 10 are expected to compare to shots hit with conventional iron clubs, the Titleist® 670. These conventional clubs are muscle-back type irons made from forged steel. The conventional 3-iron has a CGy-g, the distance of the center of gravity off the ground when the club head is in the address position, of about 19.6 mm. The conventional 6-iron and 9-iron have a similar CGy-g. The conventional club has a CGz-fc, the distance of the center of gravity back from a point on the hitting face about 15 mm above the ground when the club is in an address position, of about 4.83 mm. For reference, FIG. 5 shows standard center of gravity position nomenclature for irons.

Table 1 shows locations of the expected centers of gravity achievable on inventive club heads made according to the embodiment shown in FIG. 1 compared to the locations of the centers of gravity on the Titleist® 670 clubs. Several benefits realized by this shift in the position of the center of gravity of the inventive club are discussed below with reference to FIGS. 6-8.

TABLE 1

CGy-g and CGz-fc for Inventive Club Heads and Titleist ® 670 Club Heads

| | CGy-g | Difference, CGy-g | CGz-fc | Difference, CGz-fc |
|---|---|---|---|---|
| Inventive 3-Iron | 14.6 mm ± 2 mm | 5 mm lower (7 mm to 3 mm) | 8.5 mm ± 2 mm | 3.67 mm lower (5.67 mm to 1.67 mm) |
| Conventional 3-Iron | 19.6 mm | | 4.83 mm | |
| Inventive 6-Iron | 14.0 mm ± 2 mm | 5.6 mm lower (7.6 mm to 3.6 mm) | 10.6 mm ± 2 mm | 5.44 mm lower (7.44 mm to 3.44 mm) |
| Conventional 6-Iron | 19.6 mm | | 5.16 mm | |
| Inventive 9-Iron | 10.6 mm ± 2 mm | 9 mm lower (11 mm to 7 mm) | 16.5 mm ± 2 mm | 10.96 mm lower (12.96 mm to 8. mm) |
| Conventional 9-Iron | 19.6 mm | | 5.54 mm | |

In FIGS. 6-14, the curves shown in broken lines are related to the inventive clubs, and the curves shown in solid lines are related to the conventional clubs.

Figure 6:
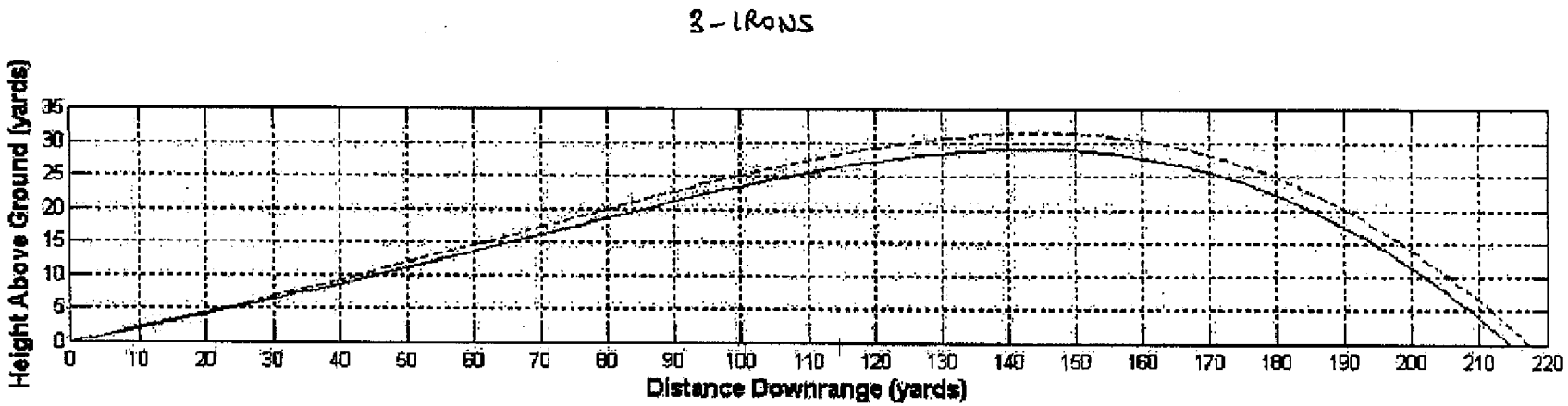
FIG. 6 is a graphical representation of trajectory, height versus downrange distance, for a conventional 3 iron club and a 3 iron club according to the present invention.
Figure 9:
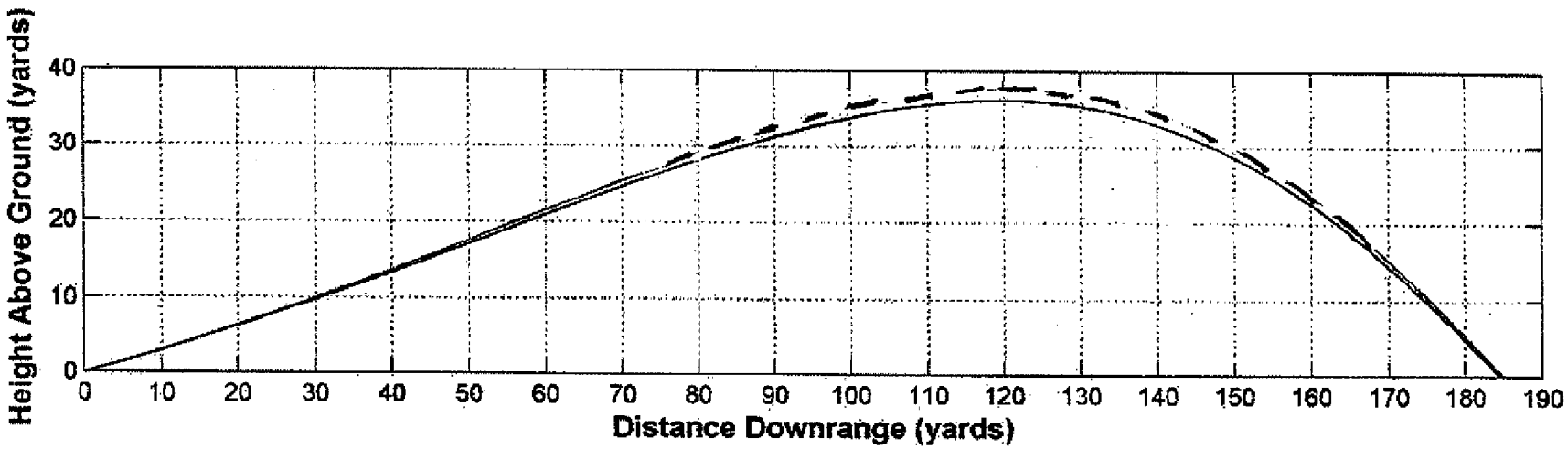
FIGS. 9-11 are similar to FIGS. 6-8 for conventional and inventive 6 iron clubs.

Referring to FIG. 6, a first benefit of having a lower and aft center of gravity on a club head is shown. The solid line in FIG. 6 shows a shot trajectory, plotted as height in yards versus distance in yards, for a ball hit by the conventional 3-iron, having a CGy-g of about 19.6 mm. The broken line in FIG. 6 shows an anticipated shot trajectory for the same ball hit by the inventive club 3-iron, having a CGy-g of about 14.6. Both balls were hit by a PGA Tour swing, assumed to have a speed of about 98 mph. As shown, the ball hit by the inventive club achieves greater height and distance compared to the conventional. The low and aft center of gravity contributes to a greater initial ball speed and a greater launch angle to produce the higher and longer hits. FIG. 9 shows the anticipated shot trajectory for the inventive 6-iron as compared to the comparative 6-iron with club head speed of about 95 mph. While the carry distances are substantially the same, the inventive club can achieve higher trajectory, which can reduce the roll distance for better control. FIG. 9 shows the anticipated shot trajectory for the inventive 9-iron as compared to the comparative 9-iron with club head speed of about 92 mph. Again, while both clubs can achieve similar carry distance, the inventive 9-iron club has a higher trajectory, which can reduce roll distance for better control.

Figure 7:
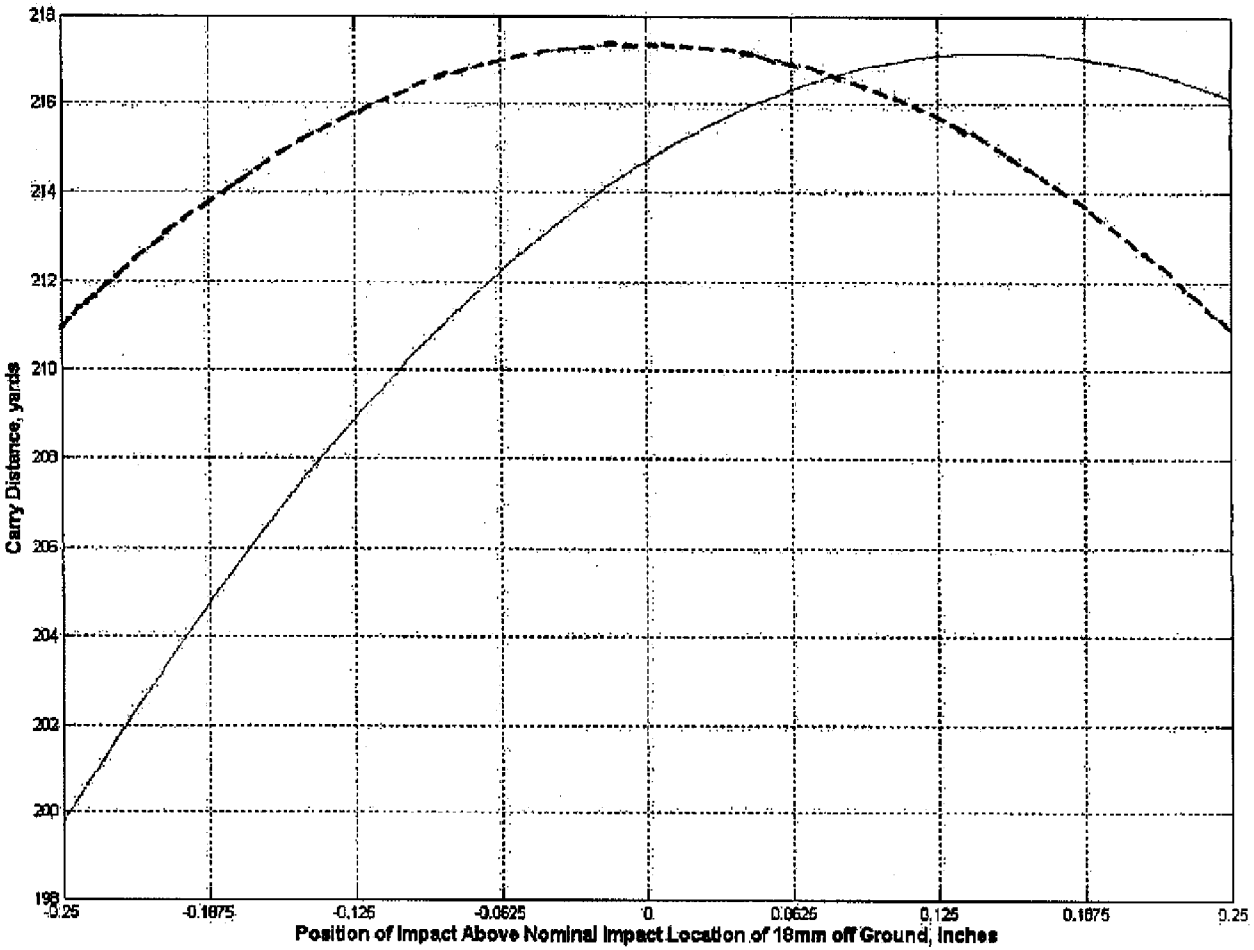
FIG. 7 is a graphical representation of carry distance versus hitting face impact location as deviated from the nominal striking point for conventional and inventive 3 iron clubs.

Another benefit of having a low and aft center of gravity on a 3 iron club head is shown in FIG. 7. The nominal striking point on the hitting face of a club, i.e., the striking point for an ideal hit, is about 18 mm above the ground, as measured when the club is in the address position. An impact with the club face at a point below the nominal striking point is called a "thin" shot, while impacts with the club face above the nominal striking point is called a "fat" shot. Thin and fat shots adversely impact the carry distance, as total carry distance is less than if the shot were hit from the nominal striking point. In FIG. 7, the carry distance of a ball hit by the conventional 3-iron is plotted (as the solid line) against the deviation of impact position of the ball on the hitting face from the nominal striking point. For shots hit thin, the inventive club offers significant improvement in carry distance, as reflected by the broken line in FIG. 7. For example, a shot hit ¼ inch thin with the conventional Titleist® 670 3-iron loses about 15 yards in carry distance. However, a shot hit ¼ inch thin with the inventive club 3-iron loses only about 6 yards in carry distance. As such, the inventive club is significantly more forgiving for thin shots.

Figure 10:
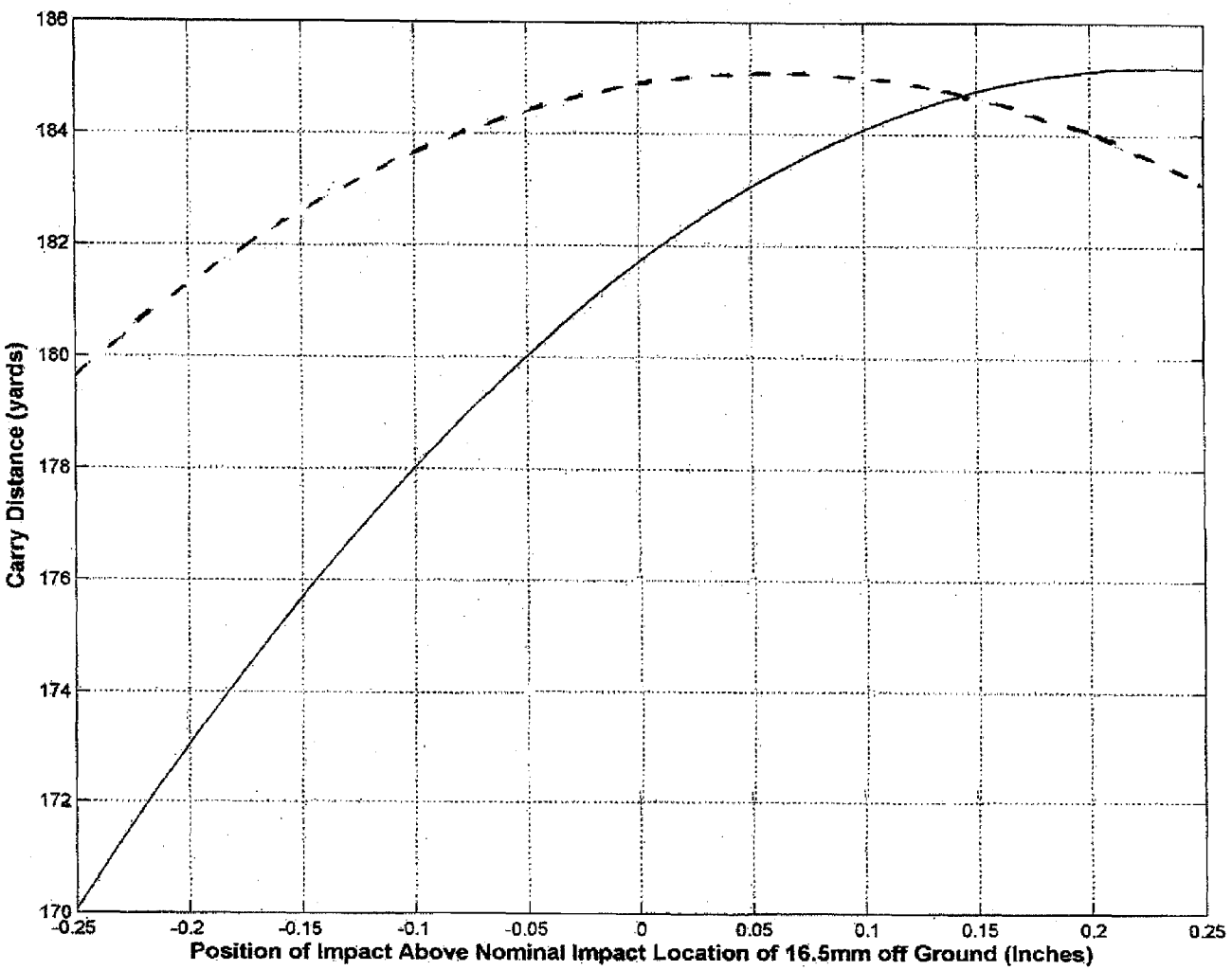

Similar benefits for "thin" and "fat" shots hit by the inventive 6-iron club are shown in FIG. 10 where the "ideal" striking point is about 16.5 mm above the ground. For example, a shot hit ¼ inch thin with the inventive 6-iron club loses about 10 yards less than the comparative 6-iron club. A shot hit ¼ inch fat produces about 2 yards difference between the inventive and comparative 6-iron club.

Figure 13:
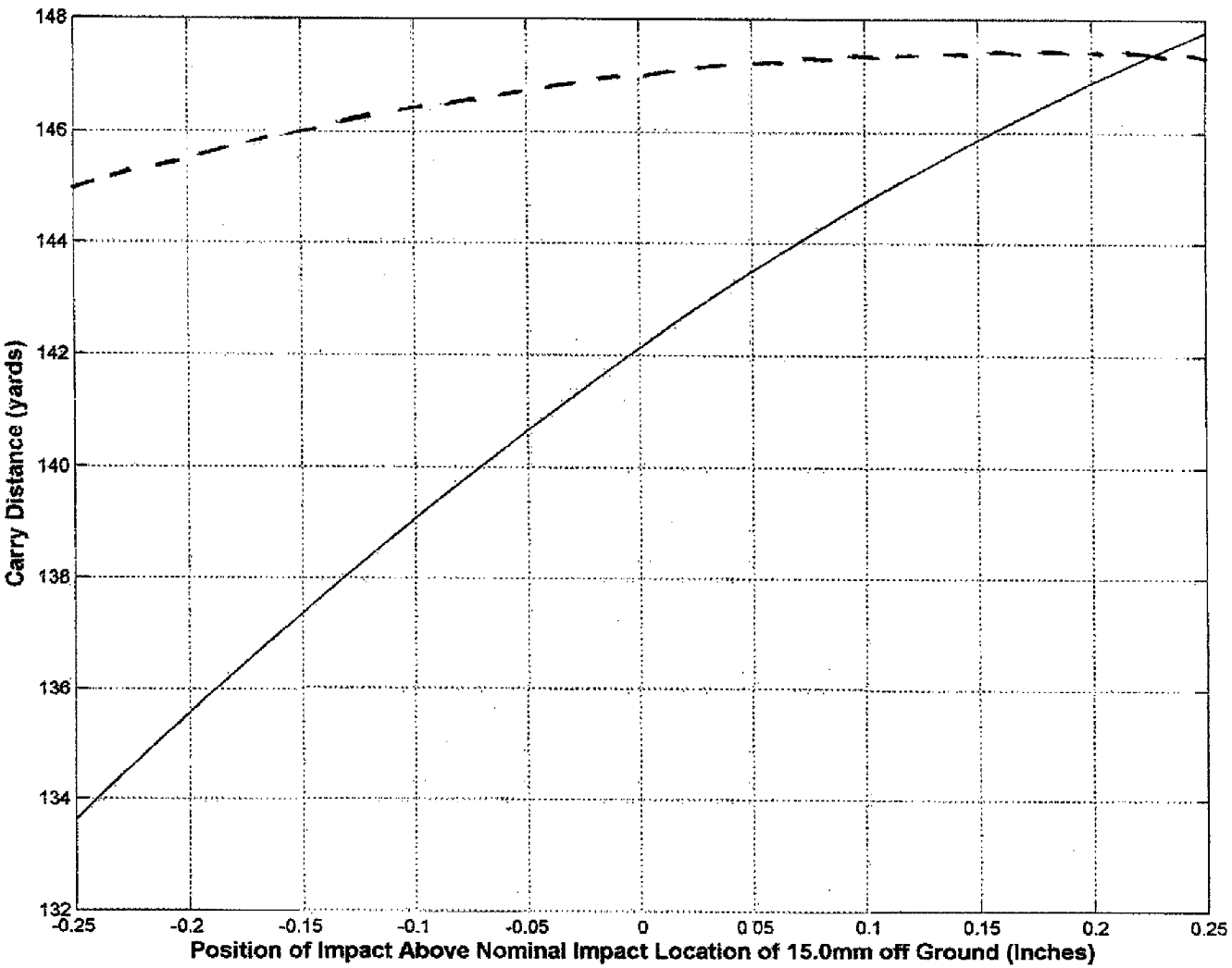

FIG. 13 shows the benefits for "thin" and "fat" shots with the inventive 9-iron club at the "ideal" striking point of about 15 mm above the ground. A shot hit 4 inch thin with the inventive 9-iron club loses about 11 yards less than with the comparative 9-iron. ¼ inch fat shots produce similar distances for both clubs.

Figure 8:
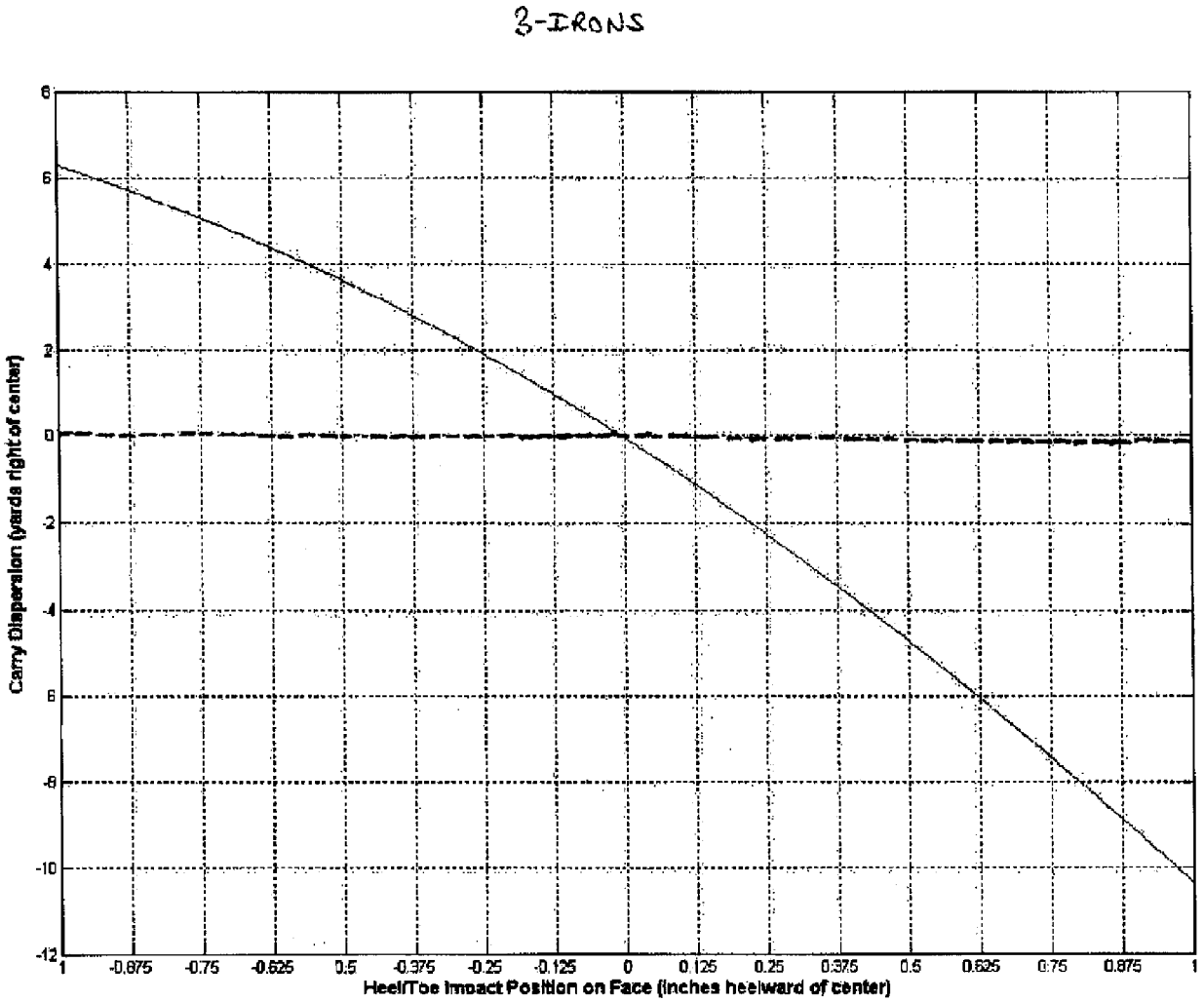
FIG. 8 is a graphical representation of carry dispersion versus hitting face impact location as heel-toe deviated from the center for conventional and inventive 3 iron clubs.

Yet another benefit realized by the inventive club with a low and aft center of gravity is forgiveness for heel-toe hits, i.e., an off-center hit flies straighter. As shown in FIG. 8, the carry dispersion of the conventional and inventive 3-irons are plotted against the deviation of impact position of the ball on the hitting face from the center (heel-ward or toe-ward hits.) Carry dispersion is the lateral distance between a centered hit and a toe/heel hit. For example, a shot struck one inch toward the toe with the conventional 3-iron (with the face square to the target line and path) lands about 6 yards right of the target. A similar shot with the inventive club 3-iron lands on the target. The aft center of gravity allows for a so-called "gear effect", where toe shots produce hook spin. While the toe shots of a conventional 3-iron have push and a straight slice which causes the ball to land to the right of the target, it is believed that the inventive club 3-iron still produces a push but also adds sufficient hook to cause the ball to curve back to the target. A shot struck one inch toward the heel with the inventive club flies on target and a similar shot with the conventional 3-iron produces a shot about 10 yards left of the target.

Figure 11:
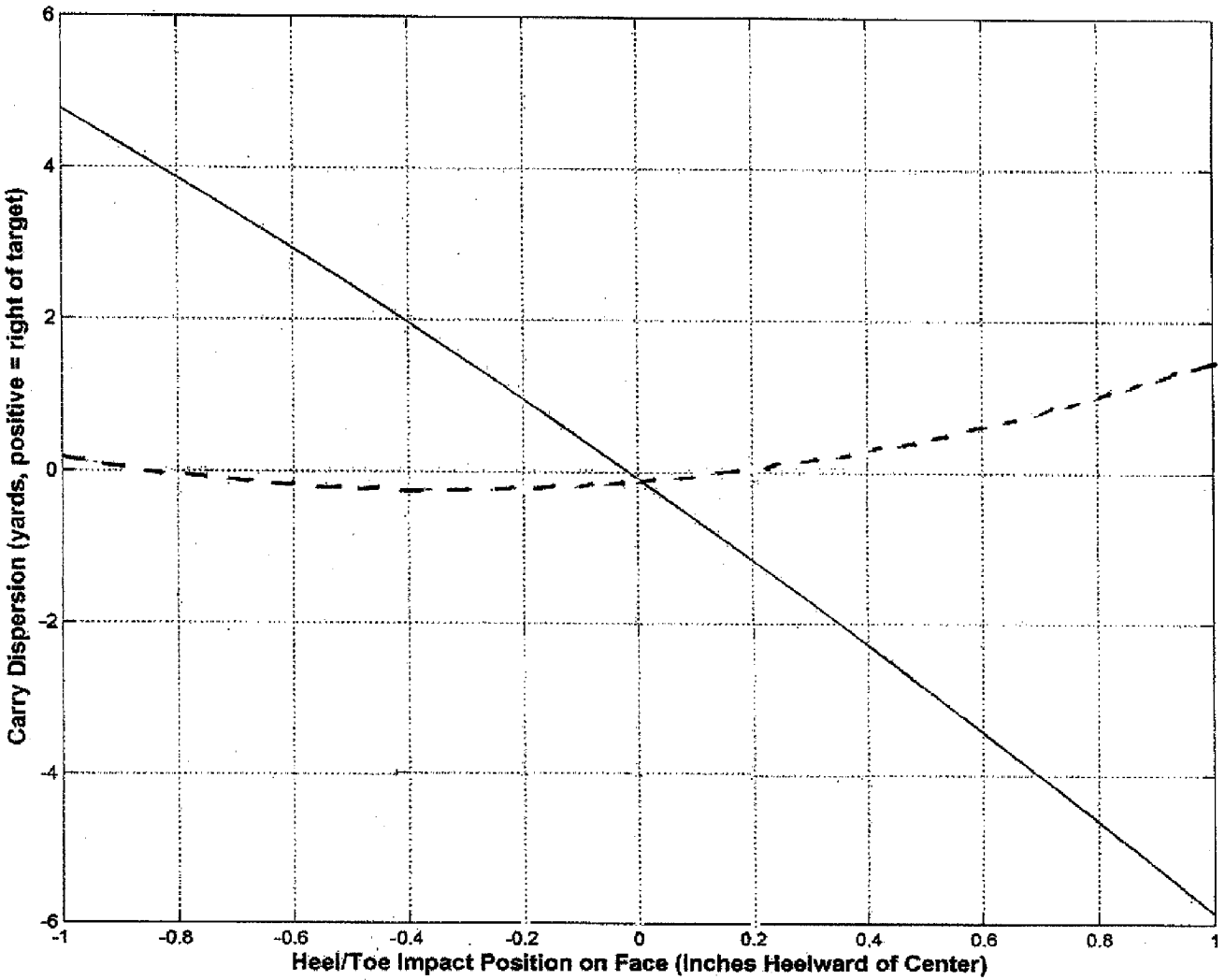
Figure 12:
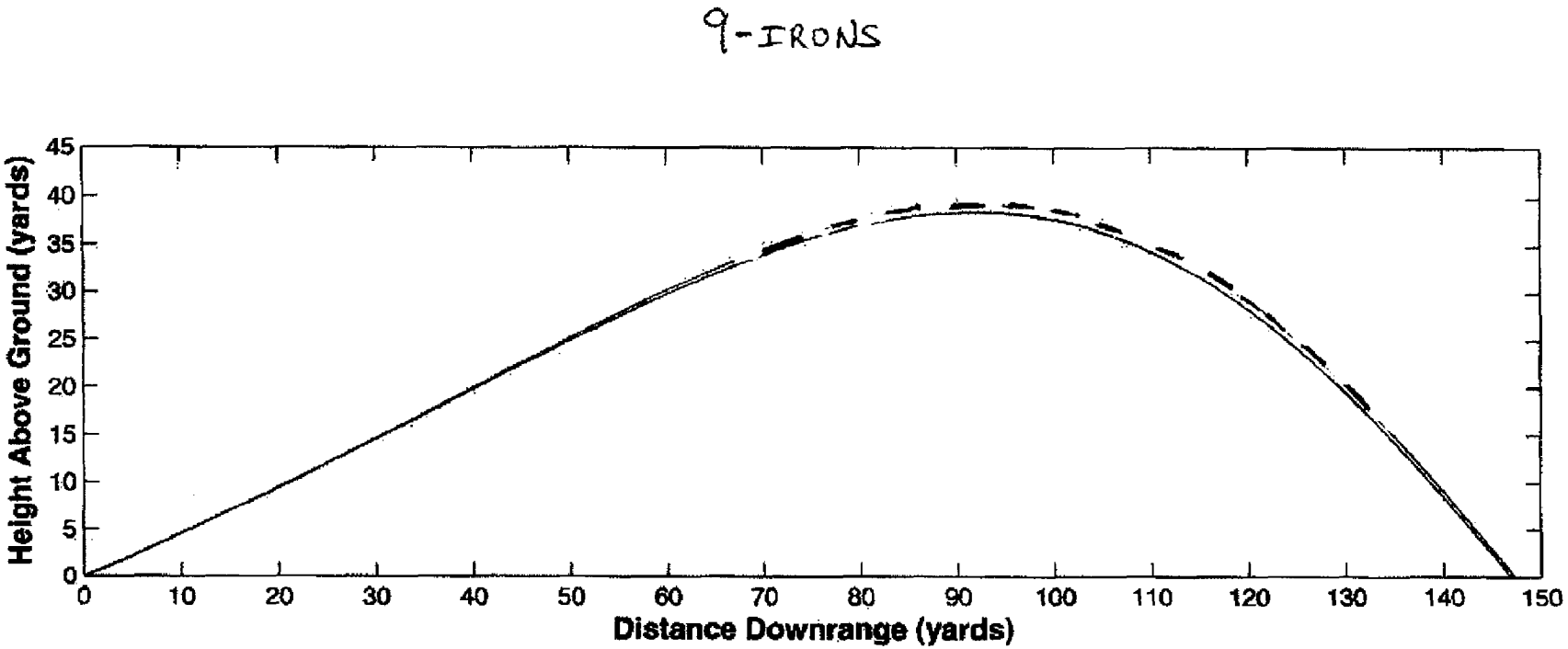
FIGS. 12-14 are similar to FIGS. 6-8 for conventional and inventive 9 iron clubs.

Similarly, a hit one inch toward the toe with the inventive 6-iron is substantially on-center, and a similar shot with the conventional 6-iron is about 5 yards off-center, as shown in FIG. 11. A hit one inch toward the heel with the inventive club is about 1.5 yards off-center, while a similar shot with the conventional 6-iron produces a shot 6 yards left of target.

Figure 14:
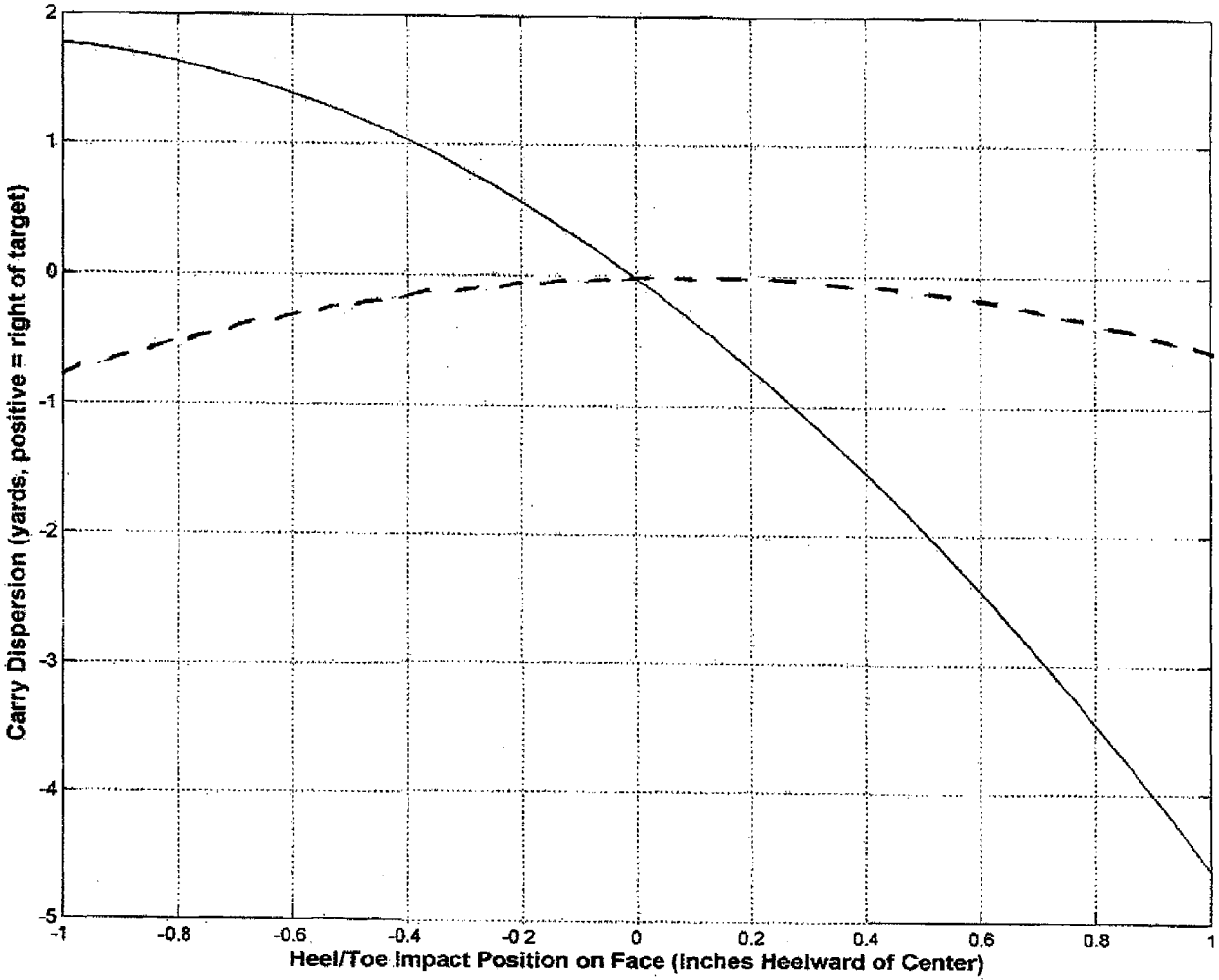

A hit one inch toward the toe with the inventive 9-iron is less than 1 yard off-center, and a similar shot with the conventional 9-iron is about 2 yards right of target, as shown in FIG. 14. A hit one inch toward the heel with the inventive club is also less than 1 yard off-center, and a hit one inch toward the heel with the comparative club about 4.5 yards left of center.

Additional benefits are also possible with a low and aft center of gravity club. For example, a ball hit with such a club tends to roll about 10% less than similar balls hit with conventional clubs. These benefits are realized by all players, regardless of swing speed. However, the centers of gravity may be shifted to different positions to optimize for the slower swing speed. For example, for slower swing speeds, the placement of the center of gravity on the hitting face is even further aft than described above.

For clubs with centers of gravity optimized for PGA Tour play, the slower swing speed players would still see the beneficial effects of the inventive club, but to a lesser degree. For example, using a PGA Tour optimized 3-iron, a slower swing speed player would lose about 8 yards on a ¼ inch thin shot versus about 12 yards if the slower swing speed player used a conventional club. The carry dispersion for a slower swing speed player using a PGA Tour optimized club is about 1 yard right of center versus about 4 yards if the slower swing speed player used a conventional club. Overall, for all clubs in the set, a slower swing speed player would likely still obtain about 75% of the possible enhancement in play if that player were to use a club optimized for a PGA Tour player.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

We claim:

1. An iron-type club head comprising:

a first section comprising a hitting face and at least a section of a hosel, wherein the first section comprises a first material having a first density;

a second section connected to the first section, wherein the second section comprises a second material having a second density, wherein the second density is less than the first density; and a third section comprising a substantial portion of a sole and connected to the first section and the second section, wherein the third section comprises a third material having a third density, wherein the third density is greater than the first density, wherein the first section, second section and third section are co-molded into a unitary club.

2. The club head of claim 1, wherein the first density is between about 6 grams/$cm^3$ and about 10 grams/$cm^3$.

3. The club head of claim 2, wherein the first density is about 8 grams/$cm^3$.

4. The club head of claim 2, wherein the first material comprises stainless steel or carbon steel.

5. The club head of claim 1, wherein the second density is less than about 3 grams/$cm^3$.

6. The club head of claim 5, wherein the second density is about 1.8 grams/$cm^3$.

7. The club head of claim 5, wherein the second material comprises plastic, urethane, aluminum silica, magnesium or aluminum.

8. The club head of claim 1, wherein the third density is between about 16 grams/$cm^3$ and about 20 grams/$cm^3$.

9. The club head of claim 8, wherein the third density is about 18 grams/$cm^3$ to about 19 grams/$cm^3$.

10. The club head of claim 8, wherein the third material comprises tungsten or tungsten-loaded plastic.

11. The club head of claim 1, wherein the second section attaches the first section to the third section.

12. The club head of claim 11 further comprising at least one structure formed on or in the third section configured to secure the third section to the second section.

13. The club head of claim 12, wherein at least one structure is a protrusion extending from the third section and into the second section, and wherein the second section is formed around the protrusion.

14. The club head of claim 12, wherein at least one structure is a channel formed at least partially through the third section, and wherein at least a portion of the second section extends into the channel.

15. The golf club head of claim 1, wherein the third section comprises a back flange of the golf club head.

16. The golf club head of claim 15, wherein the back flange is substantially perpendicular to the sole.

17. A set of iron-type clubs comprising:

at least one club comprising a first section comprising a hitting face, wherein the first section comprises a first material having a first density, a second section connected to the first section, wherein the second section comprises a second material having a second density, wherein the second density is less than the first density, and a third section comprising substantially an entire sole and a back flange and connected to the first section and the second section, wherein the third section comprises a third material having a third density, wherein the third density is greater than the first density, and wherein the at least one club has a center of gravity less than about 15 mm as measured from the ground when the at least one club is in an address position, and wherein the first section, second section and third section of the at least one club are co-molded into a unitary club.

18. The golf club head of claim 17, wherein the first section comprises at least a section of a hosel.

* * * * *